US011293146B2

(12) United States Patent
Hu

(10) Patent No.: US 11,293,146 B2
(45) Date of Patent: Apr. 5, 2022

(54) ONE-WAY LOOP MOSAICKING FOR HIGHER TRANSPORTATION CAPACITY AND SAFETY

(71) Applicant: Xiayong Hu, Rochester Hills, MI (US)

(72) Inventor: Xiayong Hu, Rochester Hills, MI (US)

( * ) Notice: Subject to any disclaimer, the term of this patent is extended or adjusted under 35 U.S.C. 154(b) by 199 days.

(21) Appl. No.: 16/766,743

(22) PCT Filed: Nov. 27, 2019

(86) PCT No.: PCT/US2019/063690
§ 371 (c)(1),
(2) Date: May 25, 2020

(87) PCT Pub. No.: WO2021/107952
PCT Pub. Date: Jun. 3, 2021

(65) Prior Publication Data
US 2021/0404123 A1 Dec. 30, 2021

(51) Int. Cl.
*E01C 1/00* (2006.01)
*G08G 1/081* (2006.01)

(52) U.S. Cl.
CPC ..... *E01C 1/002* (2013.01); *G08G 1/081* (2013.01)

(58) Field of Classification Search
None
See application file for complete search history.

(56) References Cited

U.S. PATENT DOCUMENTS 5,821,878 A * 10/1998 Raswant ..... G08G 1/082 340/907
5,959,553 A * 9/1999 Raswant ..... G08G 1/082 340/907
6,424,271 B2 * 7/2002 Raswant ..... G08G 1/095 340/907
9,990,846 B1 * 6/2018 Katz ..... G08G 1/08

FOREIGN PATENT DOCUMENTS

WO WO-2021107952 A1 * 6/2021 ..... G08G 1/081

* cited by examiner

*Primary Examiner* — Julie B Lieu

(57) ABSTRACT

The present disclosure provides new transportation design methods and a system that can improve road capacity, throughput, and travel safety as well as facilitate the current and future development of autonomous driving. The new methods and system basically eliminate all potential stopping, slowing down, and traditional crossing intersections in traffic. By mosaicking variously sized and shaped one-way loops in two-dimension and a myriad of ways and levels, the new design and system generally reduce possibilities of road accidents and utilization, reduce city pollution and improve energy efficiency, as well as encourage ride sharing and public transportation. The new design can always be compatible with existing streets and support progressive construction in phases at a controllable cost so it is practical in implementation.

20 Claims, 11 Drawing Sheets

(a)

(b)

(a)

(b)

(a)

(b)

(a)

(b)

ONE-WAY LOOP MOSAICKING FOR HIGHER TRANSPORTATION CAPACITY AND SAFETY

CROSS-REFERENCE TO RELATED APPLICATIONS

This application is a national stage application, filed under 35 U.S.C. § 371, of International Patent Application No. PCT/US2019/063690, priority date is Nov. 27, 2019, and filed on Nov. 27, 2019, which is incorporated by reference herein in its entirety.

FIELD

The present disclosure is in the field of civil engineering, city planning, road design, intersection design, traffic efficiency improvement, intelligent transportation, and connected smart vehicles, especially for vehicle autonomous or self-driving.

BACKGROUND

Humans make errors, and their performance is unreliable and inconsistent. Human error means that something has been done that is a deviation from the original intention and expectation. Human actions can fail in two different ways: the actions can go as planned, but the intention is inadequate; or the intention is fine, but the actions can be deficient. Human error has been cited as a primary cause contributing factor in transportation congestion, disasters and accidents, especially in vehicle driving. Autonomous-driving vehicles can reduce or prevent human error and are generally seen as the future for better transportation capacity, reliability, and safety. There are at least five reasons for vehicle autonomy: 1. Roads will be safer; 2. Road capacity and efficiency will be improved; 3. Transportation costs can be lower; 4. People are more productive; 5. It is good for the environment.

Autonomous, also called driverless or self-driving vehicles are cars, trucks, or other vehicles, in which human drivers are not required to take control to safely operate the vehicle. They normally combine sensors and software to control, navigate, and manipulate the vehicle. Different cars are capable of different levels of self-driving, and are often described on a scale of 0 to 5. Level 0: All major systems are controlled by humans. Level 1: Certain systems, such as cruise control or automatic braking, may be controlled by the car, one at a time. Level 2: The car offers at least two simultaneous automated functions, like acceleration and steering, but requires humans for safe operation. Level 3: The car can manage all safety-critical functions under certain conditions, but the driver is expected to take over when alerted. Level 4: The car is fully-autonomous in some driving scenarios, though not all. Level 5: The car is completely capable of self-driving in every situation.

Various self-driving technologies have been developed by some major automakers, researchers, and technology companies. While design details may vary, most self-driving systems create and maintain an internal map of their surroundings, based on a wide array of sensors, like cameras, radars, or lasers. Self-driving cars can be further distinguished by whether or not they are "connected", indicating whether they can communicate with other vehicles and/or infrastructure, such as next generation traffic lights. Uber's self-driving prototypes use sixty-four laser beams, along with other sensors, to construct their internal map; Google's prototypes have, at various stages, used lasers, radar, high-powered cameras, and sonar. Software then processes those inputs, plots a path, and sends instructions to the vehicle's "actuators," which control acceleration, braking, and steering. Hard-coded rules, obstacle avoidance algorithms, predictive modeling, and "smart" object discrimination help the software follow traffic rules and navigate obstacles. The above are all still partially-autonomous vehicles that require a human driver to intervene if the system encounters uncertainty. Currently autonomous driving is still in its infancy—there is no legally operating and fully-autonomous vehicle yet.

From the above, one can see that fully autonomous driving is extremely difficult to achieve if not impossible. It requires a complicated sensor system and highly intelligent algorithms. There are always exceptional situations where a failure can occur. Any failure in autonomous driving may be fatal and intolerable by the law. Therefore, a different, better designed road topology and transportation assistance method or system may be greatly helpful in achieving the higher level of autonomous driving sooner. The competition of right of way between any two vehicles is called "conflict". It is especially true at an intersection. An intersection is a location where at least two roads overlap each other. That is, an area is shared by two or more roads. Depending on the relative locations, directions, and speeds of the two vehicles driven on a road, there are four basic types of vehicle-to-vehicle traffic conflicts in traditional traffic conflict analysis: sequential conflicts (for example, a rear-end collision), diverging conflicts, merging conflicts (for example, a side-swipe collision), and crossing conflicts (for example, an intersection collision). The first one is the least problematic type, while the last one is the most dangerous type of conflict. The crossing conflict happens at intersections where two roads intersect each other orthogonally. The crossing is also called a right-angle or turning crossing. A right-angle crossing conflict happens when both of two vehicles are going straight and intersecting each other at a right angle or close to a right angle. A turning crossing conflict happens when both of two vehicles are turning and intersecting each other at a right angle or close to a right angle. When passing an intersection, vehicle driver needs to observe and respond to a lot of factors including other vehicles' behaviors, pedestrian, traffic lights, and accidental unknowns. The latter two are also considered environment elements. The above conflicts greatly affect the traffic capacity and safety of a transportation system. So, a good design of the road should reduce the number and severity level of conflicts between a moving vehicle and another vehicle, pedestrian, and its environment at the same time.

Previous attempts to improve route capacity are signalized intersection and 3D separation like clover-leaf type intersections, etc. The signalized intersection is a generic intersection transformed from a combinatorial intersection to a periodic intersection using a traffic signal to separate various stages of operation in time. The first periodic option is a "pull" intersection. Vehicles from three different directions merge into the fourth direction, thus the fourth direction pulls traffic from the other three. The second periodic option is a "push" intersection. Vehicles are pushed from one direction to the other three directions, thus the first direction pushes traffic to the other three. Compared to the non-signalized intersection, separation in time improves the intersection's overall throughput, as well as interval efficiency and interval safety because during each time section, the intersection contains less severe transportation conflicts and the vehicles can move at faster speeds. However, vehicles must come to a full stop and wait (vehicle standing) at a signalized intersection if it is not its turn to cross the intersection. Vehicle stopping or standing generally reduces transportation efficiency, increases risk of collision, wastes energy, and creates more pollution. In this aspect, it cancels out the original design purposes to a certain extent, though the overall net capacity and safety is still improved.

The 3D separation further improves the throughput, efficiency, and safety by separating the roadway both vertically and laterally with tunnels or overpasses. One of the most common examples is a clover-leaf shaped highway interchange. By separating the intersection in three dimensions, all the crossing conflicts are transformed into merging and diverging conflicts. It has twice the conflicts of the 2D case but avoids the most dangerous crossing conflicts. The 3D intersection has greater capacity and less severe angles which will permit vehicles to travel through at higher speeds.

Besides 3D separation, other existing solutions for improving driving safety include right in/out access, indirect left turn access, roundabouts, etc. Safety research suggests that intersection crash rates are related to the number of conflicts or conflict points at the intersection; the right-angle crash is the most frequent type of severe intersection crash. So, intersection designs like right-in/out access and indirect left turn access that restrict or reduce movements with a right angle at an intersection can reduce the crash rate compared to those of similar four-legged intersections. A vehicle at a right-in/out access intersection can only go straight in one direction or turn right. So, it has only two diverging and two merging conflicts. However, the vehicle is not allowed to go straight in the other direction or turn to the left without a U-turn. From the right-in/out access, an indirect left turn access intersection adds the possibility for one direction to turn to the left directly at the cost of 6 times more complexity and 4 additional turning crossing conflicts. Roundabouts, aka rotaries or traffic circles, are examples of traffic intersections which have made use of 2D separation for improved driving safety at a cost of traffic capacity. A roundabout fulfils the same twelve functional requirements as a general four-way intersection but only has a total of 8 conflicts that are less severe in comparison to the 32 conflicts in the general four-way intersection.

Therefore, there needs to be a better solution to improve both driving safety and transportation capacity without introducing other side effects. Ideally it can also improve energy efficiency and reduce pollution in the city. The new design should also have good feasibility of implementation in terms of relatively low construction costs and short project time, and able to be carried out progressively or compatibly with existing streets and buildings. It is especially desirable if the design can also facilitate and be fully compatible with the trending self-driving vehicle development.

The present disclosure provides such a solution with a new route design that eliminates any crossing conflict (right-angle crossing and turning crossing) and the need for vehicle standing/stopping in traffic. The new route has no more traditional intersections in all major roads, thus greatly improving driving safety and transportation capacity, and is especially suitable for working with autonomous vehicles and their current and future technologies. The new design and system discussed in the present disclosure also generally improves energy efficiency and reduces pollution. The new design can also be implemented progressively with a controllable cost. So, it meets the exact current needs for higher transportation capacity and safety, especially the needs for facilitation of and full compatibility with the current development of self-driving vehicles.

SUMMARY

The present disclosure provides new transportation design methods and a system that can improve road capacity, throughput, and travel safety as well as facilitate the current and future development of autonomous-driving.

By mosaicking variously sized and shaped one-way loops in two dimensions and a myriad of ways and levels, the new methods and system basically eliminate all potential stopping, waiting, slowdowns, and traditional crossing intersections in the traffic. There are no more crossing conflicts or standard diverging and merging conflicts, except for the least problematic lane-changing conflicts. As such it reduces the risk of accidents to the theoretic minimum, improves road utilization, reduces city pollution and improves energy efficiency, encourages ride sharing and public transportation, and saves money for individuals as well as the government. The new design and system provides solutions to all these problems within two dimensions and eliminates need for three-dimension solutions which are more expensive.

The new transportation system contains only one-way routes but is complete in the topology sense and fully connected at the basic loop level. The new design can always be compatible with existing streets and supports progressive construction in phases with a controllable cost, so it is practical in implementation.

DETAILED DESCRIPTION

Figure 1:
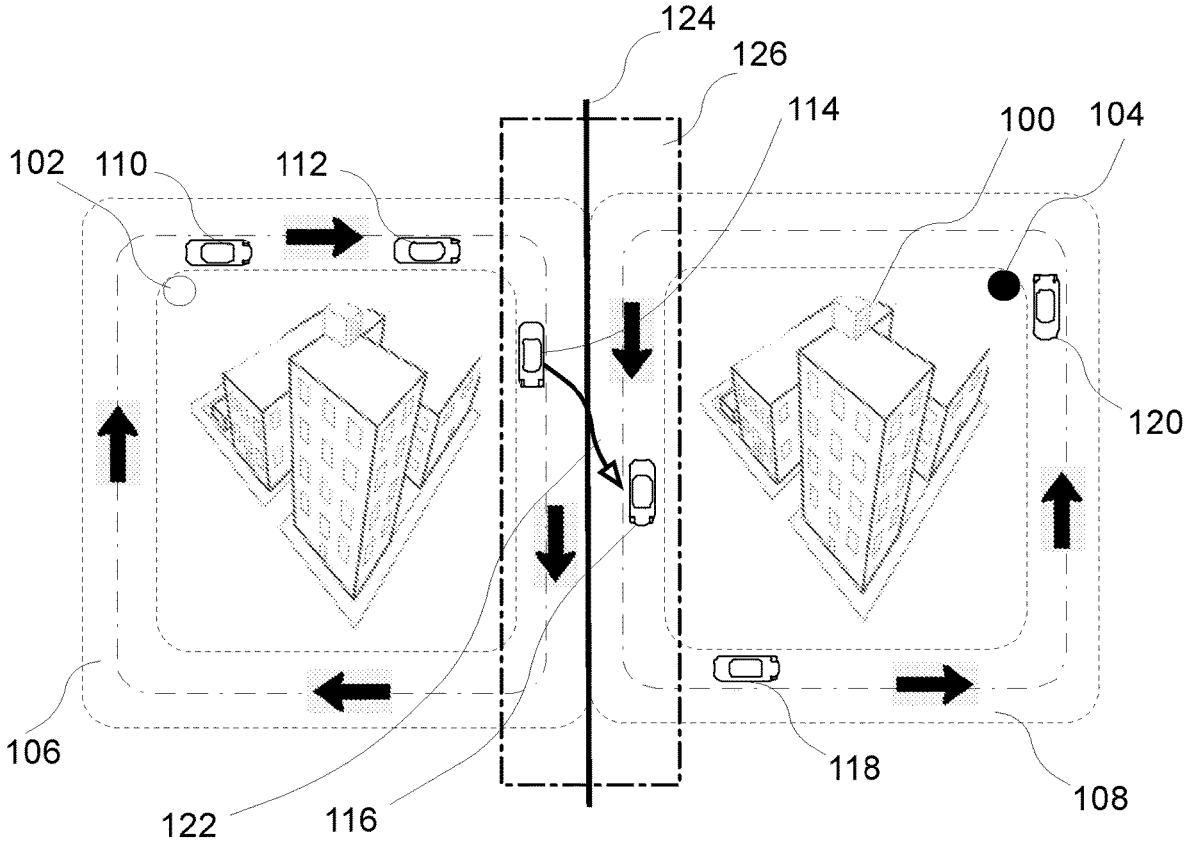
FIG. 1 illustrates a basic type of mosaicking of two one-way loops and its corresponding vector representation of the present disclosure.
Figure 1:
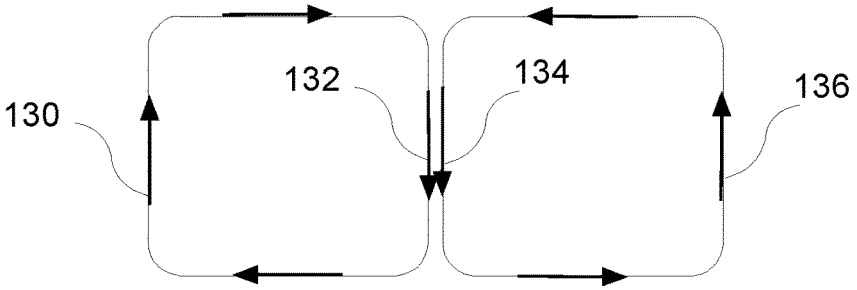

The terminology used herein is for the purpose of describing particular embodiments only and is not intended to be limiting of the disclosure. As used herein, the term "and/or" includes any and all combinations of one or more of the associated listed items. As used herein, the singular forms "a," "an," and "the" are intended to include the plural forms as well as the singular forms, unless the context clearly indicates otherwise. "they", "he/she", or "he or she" or are used interchangeably because "they", "them", or "their" can now be used as singular gender-neutral pronoun in modern English. It will be further understood that the terms "comprises" and/or "comprising" when used in this specification, specify the presence of stated features, steps, operations, elements, and/or components, but do not preclude the presence or addition of one or more other features, steps, operations, elements, components, and/or groups thereof. Unless otherwise defined, all terms (including technical and scientific terms) used herein have the same meaning as commonly understood by one having ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. In the description, it will be understood that a number of techniques and steps are disclosed. Each of these has an individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the disclosure and the claims.

In the following description, for purposes of explanation, numerous specific details are set forth to provide a thorough understanding of the present disclosure. It will be evident, however, to one ordinarily skilled in the art that the present disclosure may be practiced without these specific details. The present disclosure is to be considered as an exemplification of the disclosure and is not intended to limit the disclosure to the specific embodiments illustrated by the figures or description below. The present disclosure will now be described by referencing the appended figures representing preferred or alternative embodiments.

The present disclosure discusses a concept of route design for automotive vehicle transportation of a city or community. The new method is mosaicking a myriad of one-way loops of various sizes and shapes to accommodate all major traffic. By eliminating all traditional intersections from major roads, the new design avoids all crossing conflicts and vehicle standing and stopping at traditional intersections, therefore greatly improving driving safety and transportation capacity. It is especially suitable for working with autonomous vehicles and their current and future self-driving technologies. The existing sensors and algorithms adopted in self-driving technologies can now work much more reliably and perform much better with the new road topologies and structures.

In yet another aspect of the present disclosure, the new design methods and traffic systems developed also generally improve energy efficiency and reduce pollution in the city. The new design can also be implemented progressively at a controllable cost along with existing streets, intersections, and human-operated vehicles. So, it is practical to implement and a way to upgrade cities by switching to a higher transportation capacity and increased safety, especially to realize the desired future of fully autonomous, connected, and smart transportation.

Figure 2:
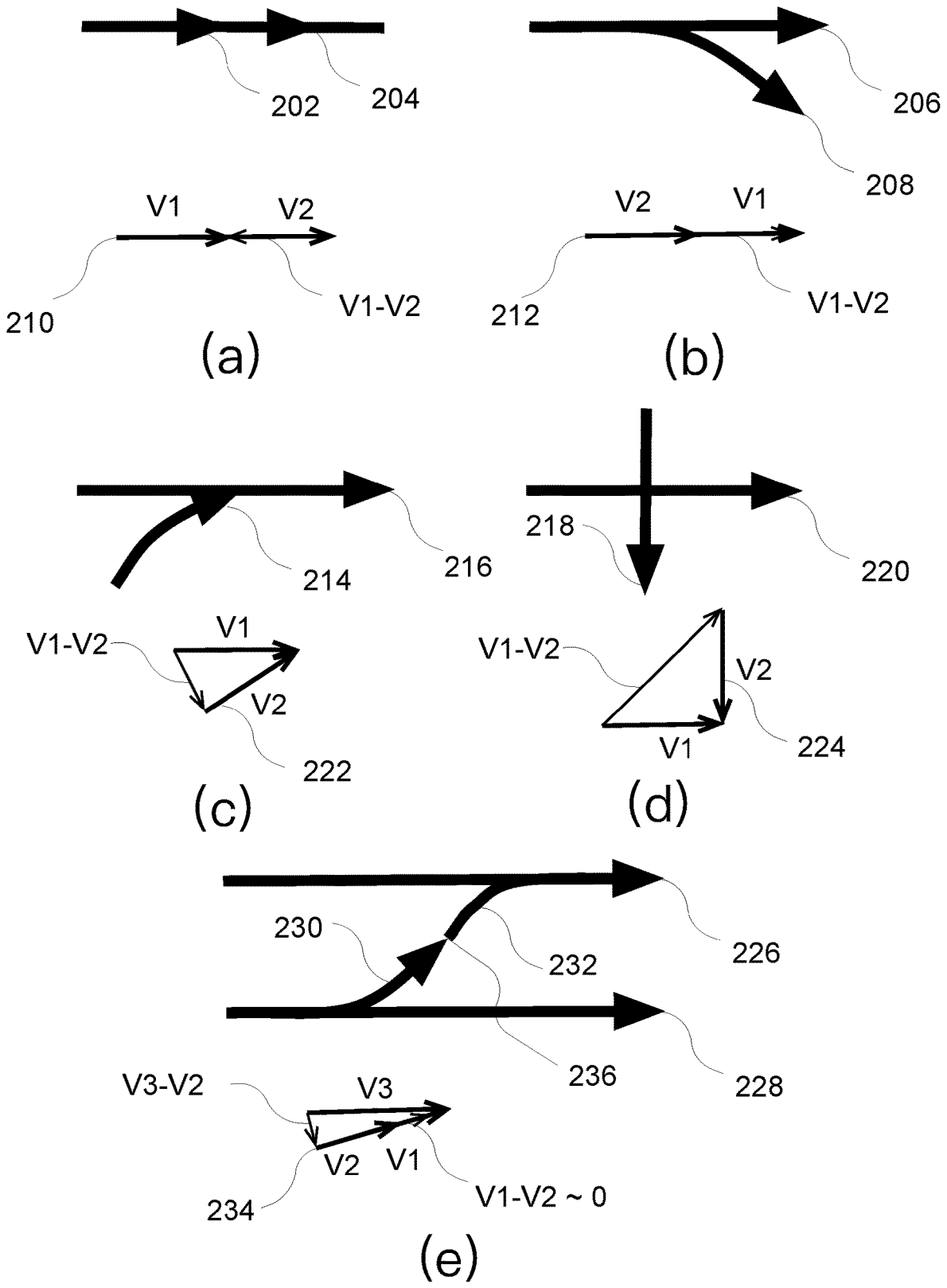
FIG. 2 illustrates five common categories of traffic conflicts and their corresponding conflicting vector representations used in the present disclosure.

In traditional traffic conflict analysis, the major traffic conflicts between two motorized vehicles are categorized into four types as illustrated in FIG. 2 (FIG. 1 will be described in detail a little later). We will add a fifth type of conflict at the end. Here we only discuss conflicts between automobiles. We ignore all conflicts between vehicle and environment or vehicle and pedestrian. The first type of conflict is sequential conflict as shown in Sub-Figure (a). Sequential conflicts occur between two vehicles (202, 204) travelling in sequences in the same lane or road; one follows the other. An accident will occur when the following vehicle (202) is travelling faster than the leading vehicle (204). Specifically, if the leading vehicle is stationary, this is called a queuing conflict. The accident that happens is called rear-end collision. This type of conflict has the least severity and can occur anywhere on any road as long as there are at least two vehicles travelling within the same lane. We can use vectors (210) to represent this traffic conflict. At the bottom of Sub-Figure (a), V1 is the speed vector of a first vehicle (leading vehicle), V2 is the speed vector of a second vehicle (following vehicle). Both vectors have the same orientation but different magnitude. The following vehicle V2 has a faster speed than the leading vehicle V1. Therefore, there might be a possibility of conflict. The measurement of the strength of the conflict is the vector difference between the two speed vectors, which is shown as V1−V2 by a smaller arrow. The direction of the difference vector is pointing from V2 to V1, and the magnitude is the length difference between V1 and V2, which is |V1−V2|. The vector direction indicates the second vehicle is going to hit the first vehicle. The severity of the conflict or collision is represented by the vector magnitude of V1−V2. The bigger the difference between the two vehicles' speed, the more severe the collision will be.

The sequential conflict is a little special because it can happen anywhere on a road as long as there is traffic. Due to its ubiquity and low severity, sometimes we might ignore and/or exclude it from a major conflict analysis hereafter.

Sub-Figure (b) shows the second type of conflict—diverging conflict. A diverging conflict is created when the flow of traffic travelling in a single direction separates into two different directions, or a single lane becomes two separate lanes (206, 208). Diverging roadways create a reverse "bottleneck", with traffic moving from a more congested and constrained space to a more open one. This is generally a good thing in itself. However, vehicles tend to slow down when changing directions or making navigation decisions. Thus, the faster moving following traffic can be negatively impacted by the slower moving leading traffic. Once the leading vehicle (208) leaves the original direction or lane, it has no conflict with the following vehicle (206) any more. So in this sense, a diverging conflict is basically a sequential conflict before the diverging point.

This can be represented by vectors (212). At the bottom of Sub-Figure (b), V1 is the speed vector of a first vehicle (following vehicle), V2 is the speed vector of a second vehicle (leading and diverging vehicle). Both vectors have the same orientation but different magnitude. The leading vehicle V2 has a slower speed than the following vehicle V1. Therefore, there might be a possibility of conflict. The measurement of the strength of the conflict is the vector difference between the two speed vectors, which is shown as V1−V2 by a smaller arrow. The difference vector has a direction from V2 pointing to V1, and a magnitude of the length difference between V1 and V2, which is |V1−V2|. The vector direction indicates that the first vehicle is going to hit the second vehicle. The severity of the conflict or collision is represented by the vector magnitude of V1−V2. The bigger the difference between the two vehicles' speeds, the more severe the collision will be. Please note that the conflict severity |V1−V2| of the diverging conflict is proportional to the diverging angle. The bigger the diverging angle, which will cause a bigger speed difference (the leading and diverging vehicle V1 slows more), therefore the more severe the collision will be.

Sub-Figure (c) shows the third type of conflict—merging conflict. A merging conflict occurs when vehicles from different lanes or directions (214, 216) merge into a single lane moving in a single direction. This situation creates a forward bottleneck and forces the traffic to move from a larger and less congested space into a narrower and more congested space. This creates a severe conflict. The second and merging vehicle (214) needs to slow down and look for a gap to enter the existing traffic (216) safely. Both vehicles can be negatively impacted by the other vehicle.

This merging conflict can be represented by vectors (222). At the bottom of Sub-Figure (c), V1 is the speed vector of a first vehicle (existing vehicle), V2 is the speed vector of a second vehicle (merging vehicle). The two vectors have a non-zero direction difference. The measurement of the strength of the conflict is the vector difference between the two speed vectors V1 and V2, which is shown as V1−V2 by a smaller arrow. The difference vector has a direction from V2 pointing to V1 (arrow tips), and a magnitude of V1−V2. The vector direction indicates that the second vehicle is going to hit the first vehicle. The severity of the conflict or collision is represented by the vector magnitude of V1−V2, also written as |V1−V2|. |V1−V2| is determined by the third side length of the triangle created by the vectors V1 and V2 (222). Generally, the bigger the difference between the two vehicles' speeds, and the bigger the merging angle is, the more severe the collision will be.

Sub-Figure (d) shows the fourth type of conflict—crossing conflict. A crossing conflict occurs when vehicles from different directions (218, 220) attempt to cross paths at a single location. Crossing conflicts are considered to be the most dangerous type of conflict and are a major concern in traffic intersections and route design. Not only are crossing collisions difficult to avoid but the damage is also bigger if they occur. The second vehicle (218) needs to look for a timing where the first vehicle (220) is not at the intersecting point when it passes. Both vehicles can be negatively impacted by the other vehicle. The effects include slowing down, speeding up, and stopping to wait.

This crossing conflict can be represented by vectors (224). At the bottom of Sub-Figure (d), V1 is the speed vector of a first vehicle (220), V2 is the speed vector of a second vehicle (218). The two vectors join at a right angle. The measurement of the strength of the conflict is the vector difference between the two speed vectors V1 and V2, which is shown as V1−V2 by a smaller arrow. The difference vector has a direction from V2 pointing to V1 (or V1 pointing to V2), and a magnitude of V1−V2. The vector direction indicates that the second vehicle is going to hit the first vehicle, or vice versa. In the crossing conflict, they are symmetric and equivalent. The severity of the conflict or collision is represented by the vector magnitude of V1−V2, also written as |V1−V2|. |V1−V2| is the third side length of the right triangle created by the vectors V1 and V2 (222). So, it is the largest among the five types of conflicts illustrated in FIG. 2 provided the magnitudes of V1 and V2 are all same in each case. Generally, the higher the two vehicles' speeds in crossing collision, the more severe the collision will be.

Sub-Figure (e) shows the fifth type of conflict we added. It is not an independent conflict type like the previous four. We discuss it here because it is an important conflict in the new traffic design of the present disclosure. The fifth conflict is called lane-changing conflict. A lane-changing conflict occurs when vehicles from different lanes (226, 228) but the same direction attempt to merge into one of the lanes. A lane-changing conflict can be considered a combination of two basic conflict types; it is a diverging conflict followed by a merging conflict. The traffic (230) is first diverging from the traffic (228). After the point (236), the traffic (232) is then merging with the traffic (226). Both vehicles in a lane-changing conflict can be negatively impacted by each other. However, the effects are different from that of the crossing conflict: they may include slowing down and speeding up, but not stopping. This is a key difference that we will discuss and use in the later description.

This lane-changing conflict can also be represented by vectors (234). At the bottom of Sub-Figure (e), it is basically a combination of the vector representation of a diverging and a merging conflict. V1 is the speed vector of a first vehicle (228) in a diverging conflict, V2 is the speed vector of a second vehicle (230, 232). The difference of the two vectors is V1−V2, which is represented by a smaller vector in the same direction. V2 vector (232) is merging with the speed vector V3 of a third vehicle (226). The combined measurement of the strength of the lane-changing conflict can be represented by the vector difference V3−V2, which is shown in Sub-Figure (e) as a smaller arrow. The difference vector has a direction from V2 pointing to V3 (arrow tips), and a magnitude of V2−V3. The above vectors' directions indicate that the first vehicle may hit the second vehicle and the second vehicle may hit the third vehicle. The severity of the combined conflict or collision is represented by the summation of vector magnitudes of both V1−V2 and V2−V3, written as |V1−V2|+|V2−V3|.

During the diverging stage, because both vehicles are driven in the same lane (228) and the speed difference V1−V2 is normally very small, that is, V1−V2~0, |V1−V2|~0. Then during the merging stage, because both vehicles are driven in the same direction, at the same speed, and are very close to each other, V3−V2~0 as well. That is, |V3−V2|~0. In reality, V2 cannot have the exact same direction as V3, so there is always a small vector difference. However, the merging angle A in lane-changing conflict shall be the smallest in all real-life merging conflicts. And |V2|~|V3|, so, $|V3-V2|^2=|V3|^2+|V^2|^2-2*|V3|*|V2|*\cos(A)$ $\sim|V3|^2+|V2|^2-2*|V3|*|V2|=0$. So, we get |V1−V2|+|V2−V3|~0+0=0. This proves that the severity of a lane-changing conflict is quite small. It is considered to be smallest compared to any other diverging conflicts, merging conflicts, or crossing conflicts. A lane-changing conflict is not normally considered to be less severe than a sequential conflict, but they are very close.

Each type of conflict has different characteristics and prevention methods. For example, the US Department of Transportation (USDOT) recommends considering the following four factors of a traffic conflict: (1) The existence of conflicts. (2) The exposure of the conflict. Exposure represents the traffic volume at the conflict point. It is the product of the two conflicting traffic stream volumes. (3) The severity of the conflict. (4) The vulnerability of the vehicles to the conflict. The vulnerability is based on the ability of a member of each conflicting stream to survive a crash and a function of where the impact occurs on each vehicle body.

For example, impacts on the rear or rear corners of the vehicle are substantially less dangerous than side or front impacts. The direction of the resulting speed between two vehicles vector indicates where the impact will likely occur on the vehicles.

Figure 3:
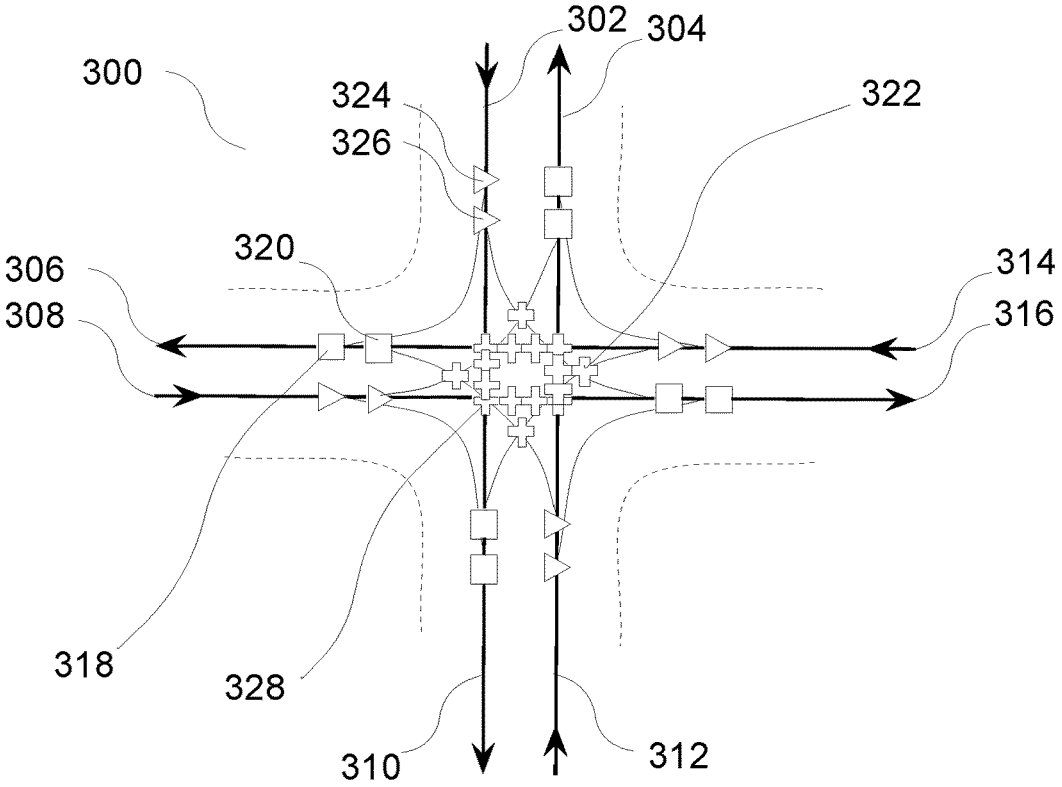
FIG. 3 illustrates two typical existing attempts to improving transportation capacity or safety as prior arts of the present disclosure.
Figure 3:
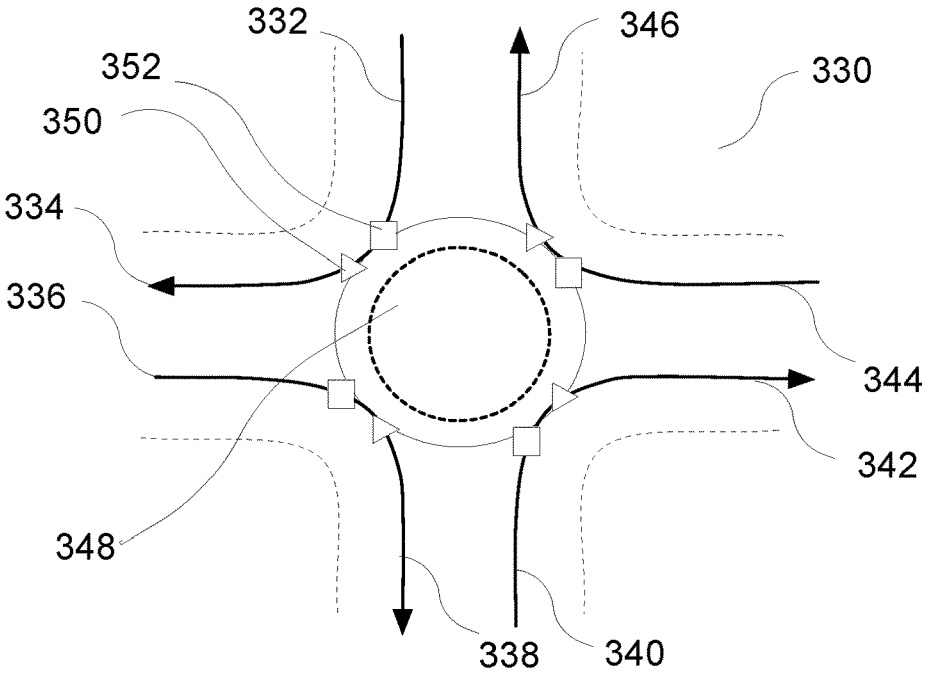

FIG. 3 illustrates two typical existing attempts for improving transportation capacity and/or safety. Sub-Figure (a) illustrates a signalized traditional four-way crossing intersection (300). Sub-Figure (b) illustrates a roundabout (330), a.k.a. rotary, traffic circle, or loop. Both are existing solutions based on 2D traffic separation. Since our solution in the present disclosure is also a 2D solution, we will ignore the comparison to all 3D separation solutions.

A traditional four-way cross intersection (300) has four road segments. Each road segment allows bi-directional traffic. The drive-in traffic (302) and drive-out traffic (304) are in the first road segment of the intersection (300). The drive-in traffic (308) and drive-out traffic (306) are in the second road segment of the intersection (300). The drive-in traffic (312) and drive-out traffic (310) are in the third road segment of the intersection (300). The drive-in traffic (314) and drive-out traffic (316) are in the fourth road segment of the intersection (300). For a vehicle from the drive-in traffic (302), at point (324), it can make a right turn onto the road segment (306). So, there is a diverging conflict at location (324). Similarly, it can make a left turn onto the road segment (316) at location (326). This is another diverging conflict at the location (326). All diverging conflicts are represented by triangle marks. When the vehicle turns right onto the road segment (306), it merges into the existing traffic on the road segment (306) at location (318). So, the location (318) has a merging conflict. Similarly, a drive-in vehicle on road segment (312) may make a left turn and merge onto the road segment (306), so, the location (320) has another potential merging conflict. All merging conflicts are represented by square marks. Similar analysis can be carried out for all the rest of the road segments. So, for every drive-in traffic of each road segment, there are two diverging conflicts. For every drive-out traffic of each road segment, there are two merging conflicts. So, there are a total of 8 diverging conflicts and 8 merging conflicts. Assuming all the conflicts inside the intersection are crossing conflicts, there are 16 crossing conflicts within the intersection centre. All crossing conflicts are represented by cross marks. For example, the crossing conflict (328) happens between a vehicle that goes from road segment (308) to road segment (316) and a vehicle that goes from road segment (302) to road segment (310). The crossing conflict (322) happens between a vehicle that turns left from road segment (302) to road segment (316) and a vehicle that turns left from road segment (314) to road segment (310), and so on and so forth. For such an intersection, all above conflicts cannot be avoided at the same time; the traffic separation has to be introduced based on time. The total time that all the vehicles take to pass the intersection is divided into small periods and only a certain group of traffic conflicts are allowed during each small period. The vehicles are informed of such periods by means of traffic lights and signals. The traffic conflicts are grouped in such a way that the road capacity and safety are greatly improved compared to without time division.

A typical roundabout (330) has four road segments. Each road segment allows bi-directional traffic. The drive-in traffic (332) and drive-out traffic (346) are on the first road segment of the roundabout (330). The drive-in traffic (336) and drive-out traffic (334) are on the second road segment of the roundabout (330). The drive-in traffic (340) and drive-out traffic (338) are on the third road segment of the roundabout (330). The drive-in traffic (344) and drive-out traffic (342) are on the fourth road segment of the roundabout (330). For a vehicle from the drive-in traffic (332), at point (352), it can make a right turn to merge into the current traffic inside the roundabout. So, there is a merging conflict at location (352). Afterwards, the vehicle may leave the roundabout traffic at location (350) onto the road segment (334). So, there is a diverging conflict at location (350). Similarly, for each of the rest of the three drive-in traffic sources (336, 340, 344), there is a merging conflict, followed by a diverging conflict. Therefore, a roundabout avoids all crossing conflicts and turns them into only 4 merging conflicts and 4 diverging conflicts.

A roundabout (330) design fulfils the complete functions as a generic four-way intersection as described in Sub-Figure (a). However, it only has a total of 8 conflicts in comparison to a total of 32 conflicts in a generic intersection. More importantly, the roundabout eliminates all 16 crossing conflicts in the generic intersection and leaves only 8 much less severe conflicts (diverging and merging conflicts). So, it greatly improves the transportation safety though not necessarily the traffic capacity. A roundabout will actually reduce the road throughput because vehicles must drive slower inside the roundabout.

A big problem of both the traditional signalized cross intersection and modern roundabout is that there are always situations where a vehicle has to fully stop and wait. In the signalized cross intersection, vehicles need to wait at red lights. In the roundabout, the entering vehicles must stop and yield to the traffic that is already in the roundabout. The stopping and waiting greatly reduce the transportation efficiency and road throughput. The requirement for stopping and waiting also adds uncertainty to safety in cases where the vehicles fail to stop due to human error or mechanical failure.

Another big problem of all the previous intersection designs is that self-driving devices and processing algorithms of current technologies cannot work reliably and successfully. The traffic situations in a traditional four-way intersection are too complicated and difficult to recognize and process reliably and/or fast enough. Even for a much-simplified roundabout, the self-driving vehicle needs to decide and process vehicle stopping and resuming.

The present disclosure provides a new route design that solves the above-mentioned problems. First, the basic building block of the new route design is a one-way loop. The one-way loop is a closed route that only allows traffic with a certain speed limit going in one direction. This direction can be either clock-wise or counter-clock-wise. There are generally no stop signs and traffic lights inside the loop. The one-way loop can be of any size or shape and can have a single or multiple lanes for a higher throughput. Second, a city or community transportation network is constructed by mosaicking multiple such one-way loops. Mosaicking means placing the one-way loops next to each other without overlapping to cover the full surface with or without gap(s). Third, only under one condition, a vehicle can leave a first loop and enter a second loop by a lane change; otherwise the vehicle stays inside the loop without stopping. The condition is: if and only if the two loops are adjacent by two lanes with traffic in the same direction. If one of the adjacent lanes from the first loop has a different traffic direction than another lane from the second loop, the lane change is not allowed.

FIG. 1 illustrates a simple type of mosaicking of two basic one-way loops as building blocks. This simple mosaicking type is called basic mosaicking. In Sub-Figure (a), the left side is a two-lane clockwise one-way loop (106) that has vehicle (110, 112, 114) driving in the right lane. The right side is a two-lane counter-clockwise one-way loop (108) that has vehicle (116, 118, 120) driving in the left lane. Inside each loop can be buildings (100) or other facilities and structures. The left or right loops can be of any shapes and/or sizes. The vehicle can change lanes freely when it is traveling inside the loop.

The left loop (106) and right loop (108) are adjacent and tangent on the side (124), where all the lanes of the loop (106) and all the lanes of the loop (108) inside the region (126) are parallel to each other and contain the same direction of traffic. The described relationship between the lanes of the two loops is hereafter called inter-tangent. The region (126) is called the inter-tangent, lane-changing, or switching area. The left one-way loop is said to be mosaicked with the right one-way loop, and vice versa. Since the same-direction tangent lane condition is met, the vehicle (114) in the first loop can switch lanes (122) to the position (116) in the second loop. After a successful lane change (122), any vehicle can travel from the left loop to the right loop. Similarly, a vehicle in the right loop (108) can switch lanes in the area (126) and travel to the left loop (106). The line (124) is hereafter called the switching line. If the adjacent and tangent lanes between two loops contain different direction traffic, then the separating line is hereafter called the separating line. The traffic is traveling at a first speed limit in the left loop and at a second speed limit in the right loop. In at least one embodiment of the present disclosure, the first speed limit is equal or close to the second speed limit. In other embodiments of the present disclosure, both speed limits are common city or highway speed limits, or any speed above zero.

Sub-Figure (a) of FIG. 1 also illustrates how a person can travel from the white point (102) in the left loop to the black point (104) in the new transportation system built according to the present disclosure. The vehicle (110) starts from the starting point (102) and travels in the right lane of the first loop. It continues to move to the position (112). Then it turns right and travels to the position (114) that is in the inter-tangent area (126). It starts to switch across three lanes to the position (116) that is now in the left lane of the second loop. The vehicle continues to move to the position (120) and arrives at the destination (104). Alternatively, vehicle can also choose to switch to the outer lane before entering the inter-tangent area (126), thus switch only one lane from the loop (106) to the outer lane of the loop (108) inside the inter-tangent area (126). After leaving the inter-tangent area (126), the vehicle can switch further to the inner lane of the loop (108).

In the case where the vehicle fails to change lanes within the switching area (126), it is not allowed to stop and wait anywhere; it shall continue travel along the first loop. After a lap, it will enter the switching area (126) again and try to change lanes into the second loop. If it is successful, the vehicle enters the second loop; otherwise it laps and tries again until there is a success or fatal failure. The fatal failures will be discussed later in the present disclosure.

First, from the exemplary description of how a vehicle travels from a location (102) in the first loop to a location (104) in the second adjacent loop, we can observe that the vehicle can reach any destination location within both the first and second loops. It does not matter where the starting point (102) and the destination point (104) are in the loops. This proves the completeness of the route design of the present disclosure.

Second, the travel path might not be the shortest but is guaranteed to have the following properties: (1) there is never a crossing conflict; (2) there are no regular diverging and merging conflicts, only sequential and lane-changing conflicts, though based on the previous discussion, a lane-changing conflict contains a diverging and merging conflict pair, the lane-changing conflict pair is the least severe among all possible diverging and merging conflicts; since sequential conflicts are ubiquitous and their severity is normally considered very low, we hereafter ignore and exclude them from the conflict analysis related to the new design of the present disclosure; that is, we consider the travel path of the new design as containing only lane-changing conflicts; (3) there is never stopping; (4) vehicles always travel at a speed limit, any significant slowing-down and speeding is not allowed. The first and second properties are related to a great improvement in transportation safety; the third and fourth properties are related to a huge road capacity increase.

From the first and second properties, the new design converts all severe traffic conflicts into the safest possible conflicts, that is, lane-changing conflicts. It eliminates the crossing conflicts and traditional cross or "T" intersections. This structural modification will greatly increase transportation safety. The greatly simplified road structure and relationships can also help a lot to implement autonomous vehicle requirements and algorithms, as well as improve their performance, speed, and reliability. The current autonomous driving can handle lane-changing much better than all other driving operations, especially the nightmare of cross intersections. Therefore, the new road design together with fully autonomous-driving vehicles can achieve a theoretic least number of the least severe collisions—the safest transportation ever in human history.

From the third and fourth properties, the new design eliminates all the stopping and slowing down situations, and basically keeps all the vehicles constantly traveling at the speed limit. This will greatly improve the road capacity, throughput, and utilization efficiency. As the new route design facilitates self-driving vehicles, the new self-driving vehicles can better handle inter-vehicle timing and distance; the road capacity, throughput, and utilization efficiency can be improved even further after all traffic on the road becomes autonomous vehicles. The upper limit of the road utilization can possibly achieve the theoretic maximum.

Sub-Figure (b) shows the vector representation of the basic loop mosaicking illustrated in Sub-Figure (a). The left one-way loop is represented by a closed vector (130) that has a clockwise direction. The right one-way loop is represented by a closed vector (136) that has a counter-clockwise direction. A sub-vector (132) in the left loop vector (130) is inter-tangent with the sub-vector (134) in the right loop vector (136). The two inter-tangent sub-vectors (132, 134) have the same orientation. The magnitude of the vector is proportional to the road length. Using vector form to represent road topology can be very concise and effective. An inter-tangent pair of sides (132, 134) in a vector representation, like the tangent line (124) between the two touching external lanes of two loops with the same traffic direction in Sub-Figure (a) is called the switching side(s) or switching edge. The similarly inter-tangent sides or lines but with different traffic directions will not be called as such. In Sub-Figure (b), the sides (132, 134) are switching sides of the loops. A basic one-way loop mosaicking so that the two loops are connected by a switching side is called basic connected or joint mosaicking; otherwise it is called basic disconnected or disjoint mosaicking.

A basic mosaicking between two basic different traffic orientation one-way loops will be a basic connected mosaicking. A basic mosaicking between two basic same traffic orientation one-way loops will be a basic disconnected mosaicking.

Figure 4:
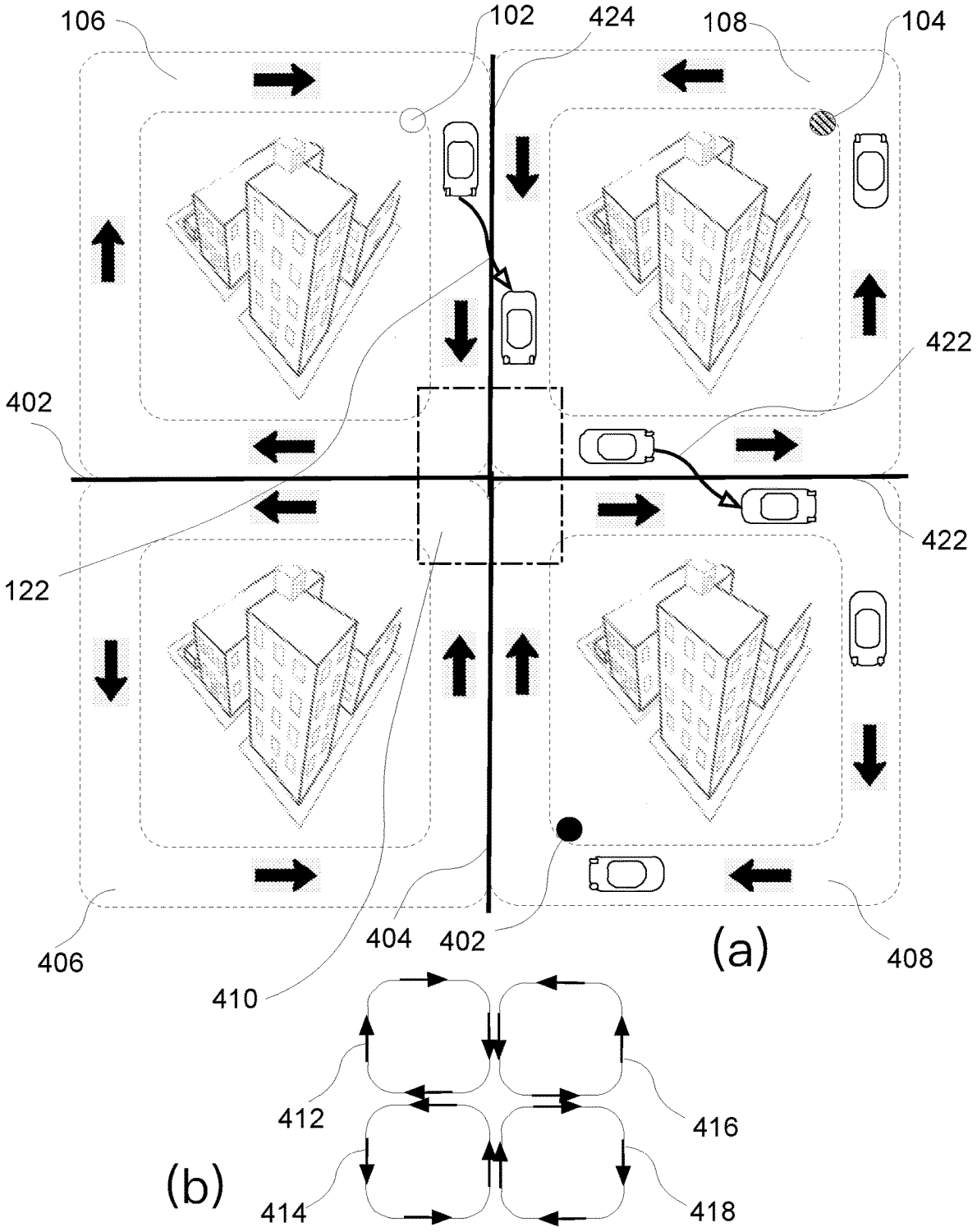
FIG. 4 illustrates an exemplary embodiment of mosaicking four one-way loops and its corresponding vector representation of the present disclosure.

FIG. 4 illustrates an exemplary embodiment of two-dimensional mosaicking of four one-way loops and its corresponding vector representation. In this embodiment, four basic one-way loops are mosaicked along both the horizontal and vertical axises (2D). There are two clockwise loops and two counter-clockwise loops. In Sub-Figure (a), the top two one-way loops (106, 108) form a typical basic connected mosaicking as described in FIG. 1, the only difference is that the two-lane loop is now a single-lane loop. Without loss of generality and obvious to one ordinarily skilled in the art, the number of lanes in any one-way loop only affects the throughput of this specific loop's traffic; it will not alter the relationship, property, function, or performance of the loop mosaicking of the present disclosure in our future discussion. Therefore, we will hereafter use single lane loops for the rest of discussion until we specifically analyze the impact of multi-lane loops later.

The left loop (106) is a clockwise loop and the right loop (108) is a counter-clockwise loop. The inter-tangent line (424) is the switching line. A vehicle can smoothly travel from a starting point (102) to the destination point (104) by changing lanes at the location (122) in the switching area, and vice versa. Similarly, the bottom two one-way loops (406, 408) form another typical basic connected mosaicking as described in FIG. 1 but flipped vertically. The left loop (406) is a counter-clockwise loop and the right loop (408) is a clockwise loop. The inter-tangent line (404) is the switching line.

These two basic mosaicked structures are further mosaicked into a larger structure along their two horizontal switching lines (402, 422). In this basic four-loop mosaicking, all inter-tangent sides or lines are connected and switchable. So, this mosaicking is called a full-connected mosaicking. Within this full-connected mosaicking, the vehicle can smoothly travel from a starting point (102) to the destination point (434) by a first lane change at the location (122) in the switching area of the top basic mosaicking, followed by a second lane change at the location (426) in the switching area between the loop (108) and the loop (408). All four switching areas have an overlapping region (410) at the very centre of the entire mosaicked structure. The centre region (410) looks like a traditional cross intersection, but it is not, because the region (410) is not an overlapping area of any two roads. In one of the preferred embodiments of the present disclosure, a vehicle is not allowed to perform any lane-changing and/or stopping within the region (410). Therefore, there does not exist any traffic conflict inside the region (410). This is on the contrary to a traditional cross intersection, where in the intersection region exists the worst traffic conflicts both in quantity and severity.

In any case where the vehicle fails a lane switch (122 or 426) at a switching line (424, 422), it is not allowed to stop and wait anywhere; it shall continue to travel along the loop it is currently in. After it travels a lap of the current loop, it will try the lane switch for a second time. If it is successful, the vehicle continues the original itinerary; otherwise it laps and tries again until it reaches success or fatal failure. The fatal failures will be discussed later in the present disclosure.

In the four-loop basic full-connected mosaicking, we can observe that the vehicle can reach any destination location within both the first and second loops. This can also be proved mathematically. That is, a four-loop basic mosaicking is also a complete mosaicking.

Sub-Figure (b) shows the vector representation of the basic four-loop mosaicking illustrated in Sub-Figure (a). The top-left one-way loop is represented by a closed vector (412) that has a clock-wise direction. The top-right one-way loop is represented by a closed vector (416) that has a counter-clock-wise direction. The bottom-left one-way loop is represented by a closed vector (414) that has a counter-clock-wise direction. The bottom-right one-way loop is represented by a closed vector (418) that has a clockwise direction. All sub-vectors inter-tangent between any two loops are switching lines or switching sides. The four mosaicked loops illustrated in Sub-Figure (b) are fully connected.

Figure 5:
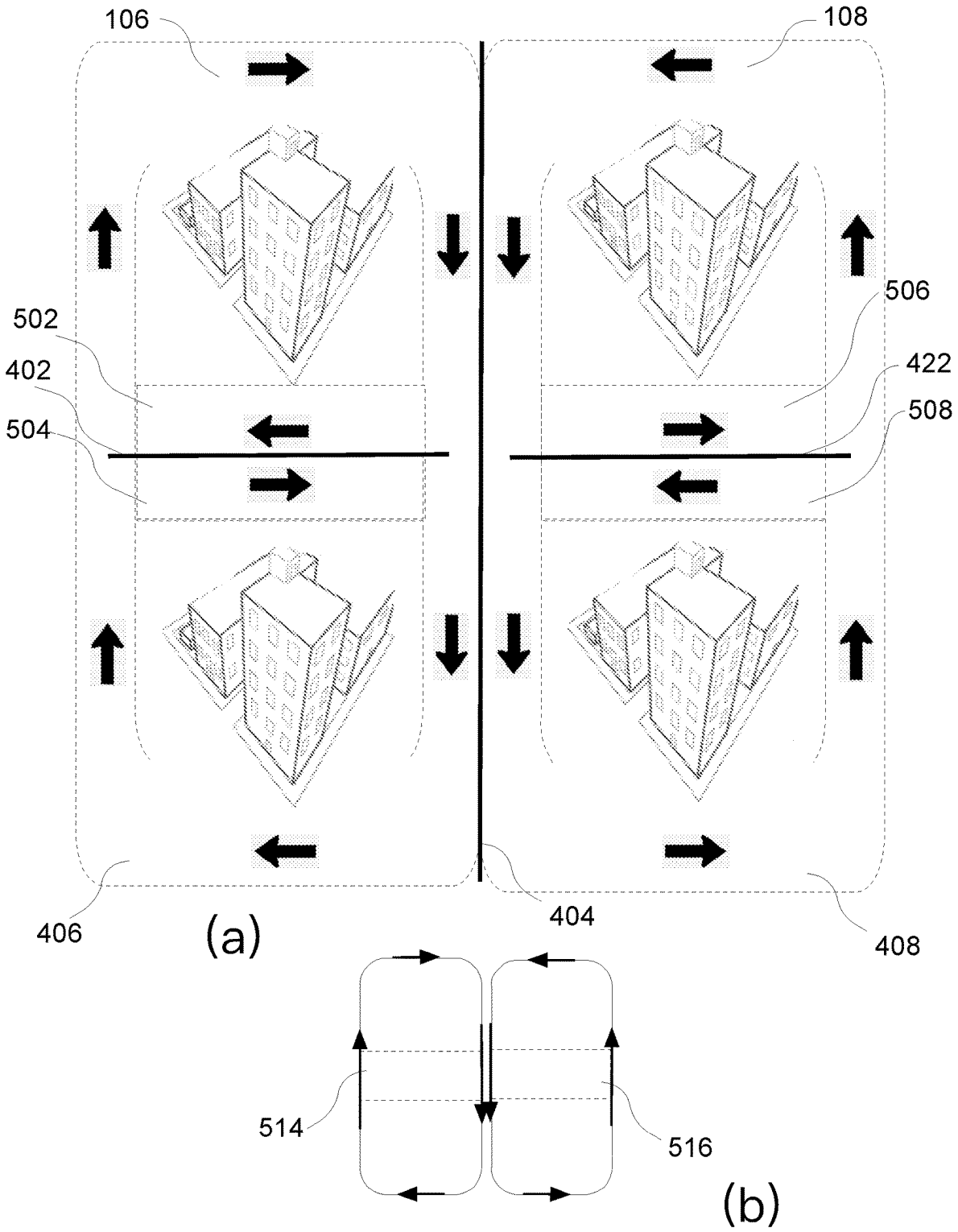
FIG. 5 illustrates an exemplary embodiment of how two one-way loops can merge and become one one-way loop with local streets, as well as the corresponding vector representation of the present disclosure.

FIG. 5 illustrates an exemplary embodiment of how two one-way loops can merge and become one one-way loop with local streets, as well as the corresponding vector representation of the present disclosure. Sub-Figure (a) consists of two expanded one-way loops. The left expanded loop (106, 406) allows clockwise traffic. The right expanded loop (108, 408) allows counter-clockwise traffic. The left expanded loop (106, 406) can be derived from a basic disconnected mosaicking of two same orientation basic one-way loops (106, 406). The top part of the left side can be initially considered a basic one-way loop with clockwise traffic. The bottom part of the left side can also be initially considered a basic one-way loop with clockwise traffic. These two same orientation loops are combined into a basic disconnected mosaicking, where the tangent lane (502) in the top loop allows a different direction of traffic from the tangent lane (504) in the bottom loop. So, the tangent line (402) is a separating line. The traffic is not allowed to change lanes between the two lanes (502 and 504). However, with a basic disconnected mosaicking, the traffic on the other sides (excluding the tangent lanes) of the top loop (106) can be allowed to enter the bottom loop (406) because their traffic orientations become compatible. This way of concatenating two lanes with compatible traffic orientations is hereafter called lane-merging or lane-concatenating. Therefore, in this embodiment of the present disclosure, the two same orientation basic one-way loops are joined together to form a larger clockwise basic one-way loop with the inner two tangent lanes (502, 504) becoming local streets. The traffic in the first local lane (502) is not allowed to cross the separating line (402) to enter the second local lane (504), and vice versa. The local lanes' traffic has their own different (lower) speed limit and may be mixed with pedestrian and parking space. The local streets are not part of the loop anymore. Similarly, the right expanded loop (108, 408) is joined by two counter-clockwise basic one-way loops (108) and (408). The loop contains two local streets (506) and (508) with a separate line (422) between them.

The traffic control in a local street will be similar to what it is before the present disclosure. The means of traffic lights, stop signs, ramps, small roundabouts, 3D separation techniques like bridges, tunnels, etc. can be used. For example, the local streets (502, 504) may have ramps to and from the main clockwise loop (106). The local traffic can take the ramp and merge into the main loop traffic. Similarly, the main loop traffic can diverge on the ramp and get onto the local streets. The local streets and local access are only complementary means for passenger pick-up and drop-off, vehicle parking, gas station, and building access. The traffic speed is normally low and it is not a major source of motion accidents. In most of embodiments of the present disclosure, the local access features have a very small percentage coverage of a city or community because the smallest one-way loop can be designed to be as small as possible before it connects to a local street. For these reasons, we do not consider local access and features hereafter in the discussion of the loop mosaicking of the present disclosure.

So, the left side of the Sub-Figure (a) is an expanded loop after merging two basic one-way loops (106, 406) with the same clockwise orientation into a larger loop. The two inner disconnected tangent lanes (502, 504) become local streets and are accessible only through traditional means. The right side is an expanded loop after merging two basic one-way loops (108, 408) with the same counter-clockwise orientation into a larger loop. The two inner disconnected tangent lanes (506, 508) become local streets. The left expanded loop and right expanded loop can further form a basic connected mosaicking. The switching line (404) indicates the traffic from one loop can switch lanes from there to another loop.

One of the benefits of merging existing loops may be to increase the length of the switching line for a connected mosaicking. Longer switching lines or switching sides can improve the success rate of a vehicle switching to another loop, therefore avoiding an extra lap of the current loop for a second try. The reduced waste of extra travel distance can improve the transportation efficiency of the present disclosure.

Sub-Figure (b) of FIG. 5 illustrates the vector representation of the joint mosaicking of two merged loops as discussed in Sub-Figure (a). The left larger loop (514) is an expanded loop with clockwise traffic; the right larger loop (516) is another expanded loop with counter-clockwise traffic. These two expanded loops can form a basic connected mosaicking because their tangent sides are switchable. The disconnected tangent sides before merging (514) and (516) are represented by dashed lines. The dashed areas are degenerated to local access which is not part of the mosaicked loop(s) anymore.

Figure 6:
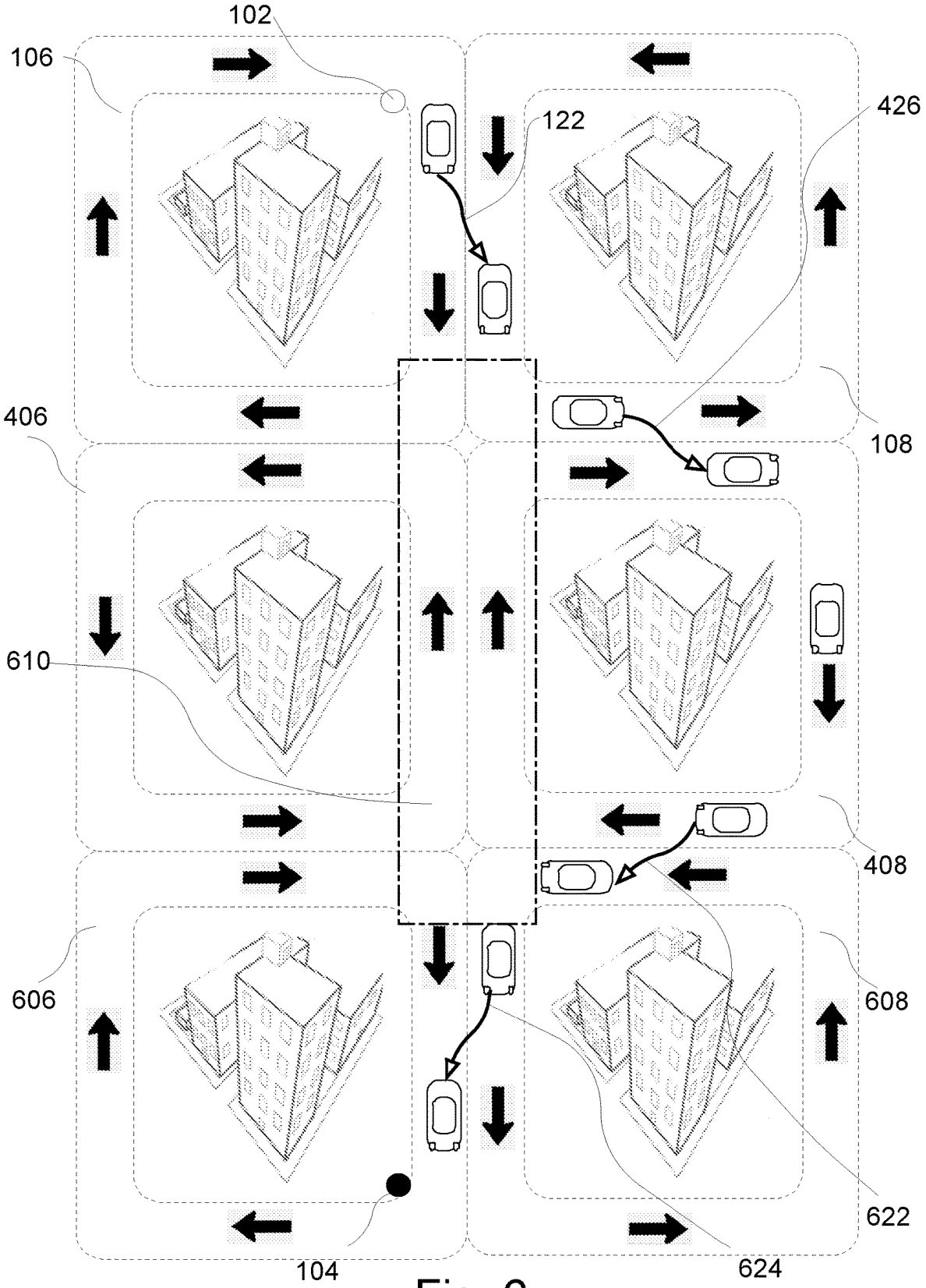
FIG. 6 illustrates an exemplary embodiment of mosaicking six one-way loops of the present disclosure.

FIG. 6 illustrates an exemplary embodiment of mosaicking six one-way loops of the present disclosure. From the two-dimensional mosaicking of FIG. 4, another pair of basic one-way loops (606) and (608) are first combined horizontally by a basic connected mosaicking. This basic connected mosaicking is then combined vertically with FIG. 4's mosaicking result through another basic connected mosaicking. The whole FIG. 6 is a fully connected 2D mosaicking of six basic one-way loops (106, 108, 406, 408, 606, 608). The FIG. 6 mosaicking is also complete. That is, a vehicle from any point in the mosaicking can travel to any other point. For example, a vehicle from a starting point (102) can travel to a destination point (104) by first making a lane switch at location (122), then a lane switch at location (426), followed by a lane switch at location (622), and lastly a lane switch at location (624). The region (610) can be considered to be a virtual intersection. A virtual intersection replaces and functions as two traditional cross intersections. The one-way loop mosaicking replaces four crossing conflicts inside a virtual intersection with four lane-changing conflicts. It is obviously not efficient in terms of driving distance (adding the distance of two horizontal sides of the middle loop), but provides much more benefit in driving safety (safer, simpler, or less possible traffic conflicts), time efficiency (travel time), road efficiency (number of vehicles passing per hour), and self-driving feature reliability (facilitating self-driving functions).

The 2D mosaicking methods described in the present disclosure can form a myriad of one-way loops of various sizes and topological shapes. The examples illustrated in this description of the present disclosure should not be considered to be limitations of the technology, are only for exemplary purposes. To a person who is ordinarily skilled in the art, many more possible permutations and/or combinations of the permutations can be easily derived from the basic principles and rules discussed or hinted at in the present disclosure.

Figure 7:
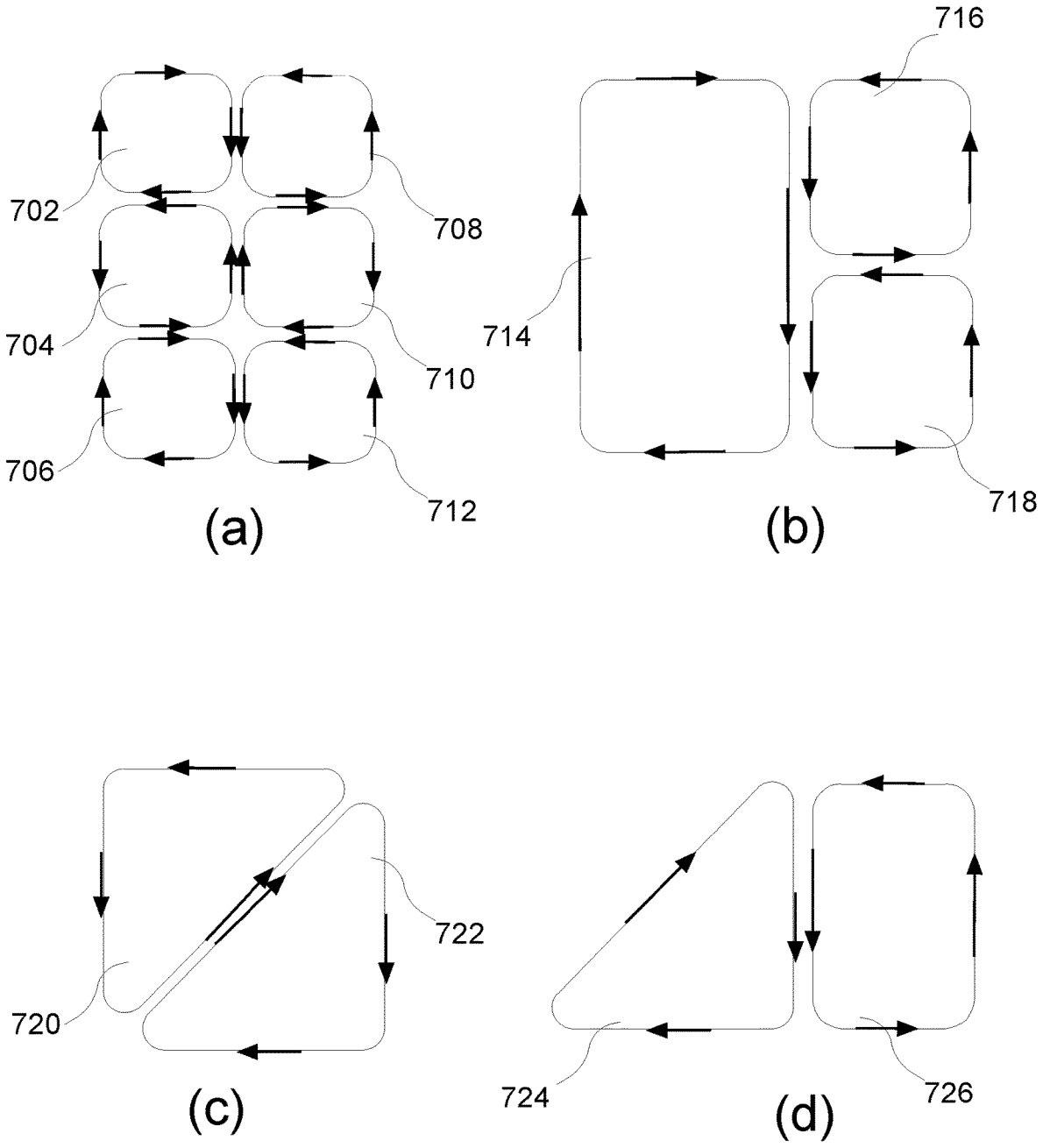
FIG. 7 illustrates vector representations of various one-way loop mosaicking examples of the present disclosure.

For example, FIG. 7 illustrates vector representations of various one-way loop mosaicking examples of the present disclosure. Sub-Figure (a) is the vector representation of FIG. 6. A total of six basic one-way loops (702, 704, 706, 708, 710, 712) are stacked in two dimensions for a fully connected mosaicking. The loops (702) and (708) are a pair of loops with opposite orientations and form a connected mosaicking in the top row. The loops (704) and (710) are a pair of loops with opposite orientations and form a connected mosaicking in the middle row. The loops (706) and (712) are a pair of loops with opposite orientations and form a connected mosaicking in the bottom row. The middle pair have opposite loop orientations to the top and bottom rows, so they form connected mosaicking with the top and bottom pairs.

Sub-Figure (b) illustrates a big clockwise loop (714) on the left side that can mosaic with a disconnected mosaicking on the right side. The disconnected mosaicking is mosaicked by a top loop (716) and a bottom loop (718). Loop (716) and loop (718) have the same counter-clockwise orientation. However, loops (716) and (718) can combine with loop (714) through a connected mosaicking. That means, though the traffic in loop (716) cannot enter loop (718) directly through their tangent sides, or vice versa, it can enter indirectly through the connected loop (714). So, the mosaicking in Sub-Figure (b) is also complete. This example represents a group of mosaicking with various sizes. [0075] Sub-Figure (c) illustrates a counter-clockwise triangle loop (720) on the top left side that can mosaic with a clockwise triangle loop (722) on the bottom right side. The result is a connected mosaicking. So, the mosaicking in Sub-Figure (c) is also complete. This example represents a group of mosaicking with triangle shapes.

Sub-Figure (d) illustrates a clockwise triangle loop (724) on the left side that can mosaic with a counter-clockwise rectangular loop (726) on the right side. The result is a connected mosaicking. So, the mosaicking in Sub-Figure (d) is also complete. This example represents a group of mosaicking with various shapes. The shapes can be, but are not limited to, rounded rectangular, rounded triangle, circles, any regular and irregular polygons, any other shapes, or combination of the above.

Figure 8:
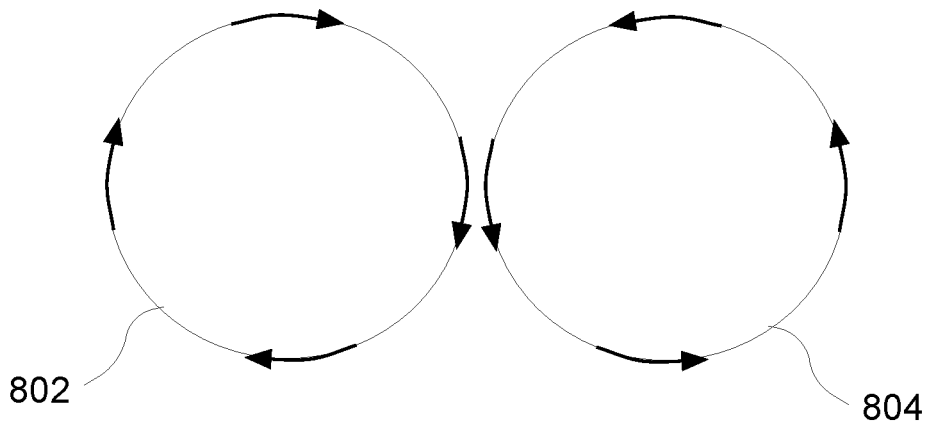
FIG. 8 illustrates vector representations of various one-way loop mosaicking examples with circles.
Figure 8:
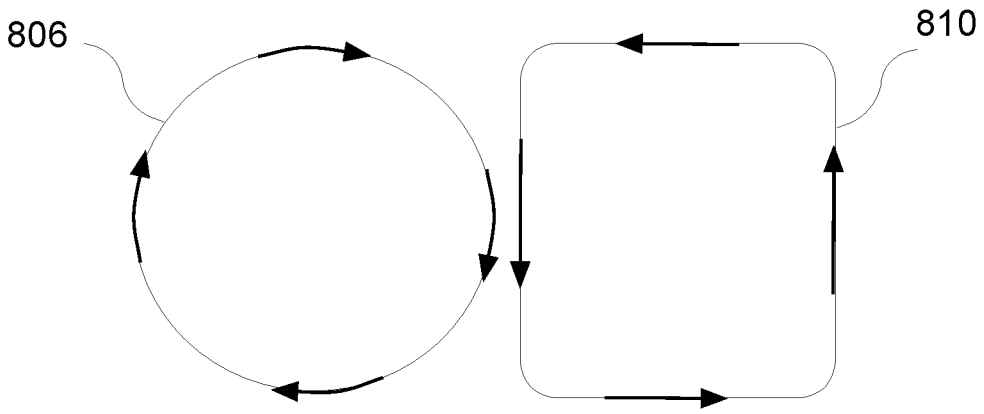

FIG. 8 illustrates vector representation of various one-way loop mosaicking examples with circles. Sub-Figure (a) illustrates a clockwise circle loop (802) on the left side that can mosaic with a counter-clockwise circle loop (804) on the right side. The result is a connected mosaicking because the tangent two sides have the same traffic orientations. So, the mosaicking in Sub-Figure (a) is also complete. This example represents a group of mosaicking with circle shapes.

Sub-Figure (b) illustrates a clockwise circle loop (806) on the left side that can mosaic with a counter-clockwise rectangular loop (810) on the right side. The result is a connected mosaicking because the tangent two sides have the same traffic orientations. So, the mosaicking in Sub-Figure (b) is also complete. If the right side is a clockwise rectangular loop, then the mosaicking is not complete. The traffic in one loop cannot enter the other loop. This example represents a group of mosaicking with hybrid circle and rectangular shapes.

Figure 9:
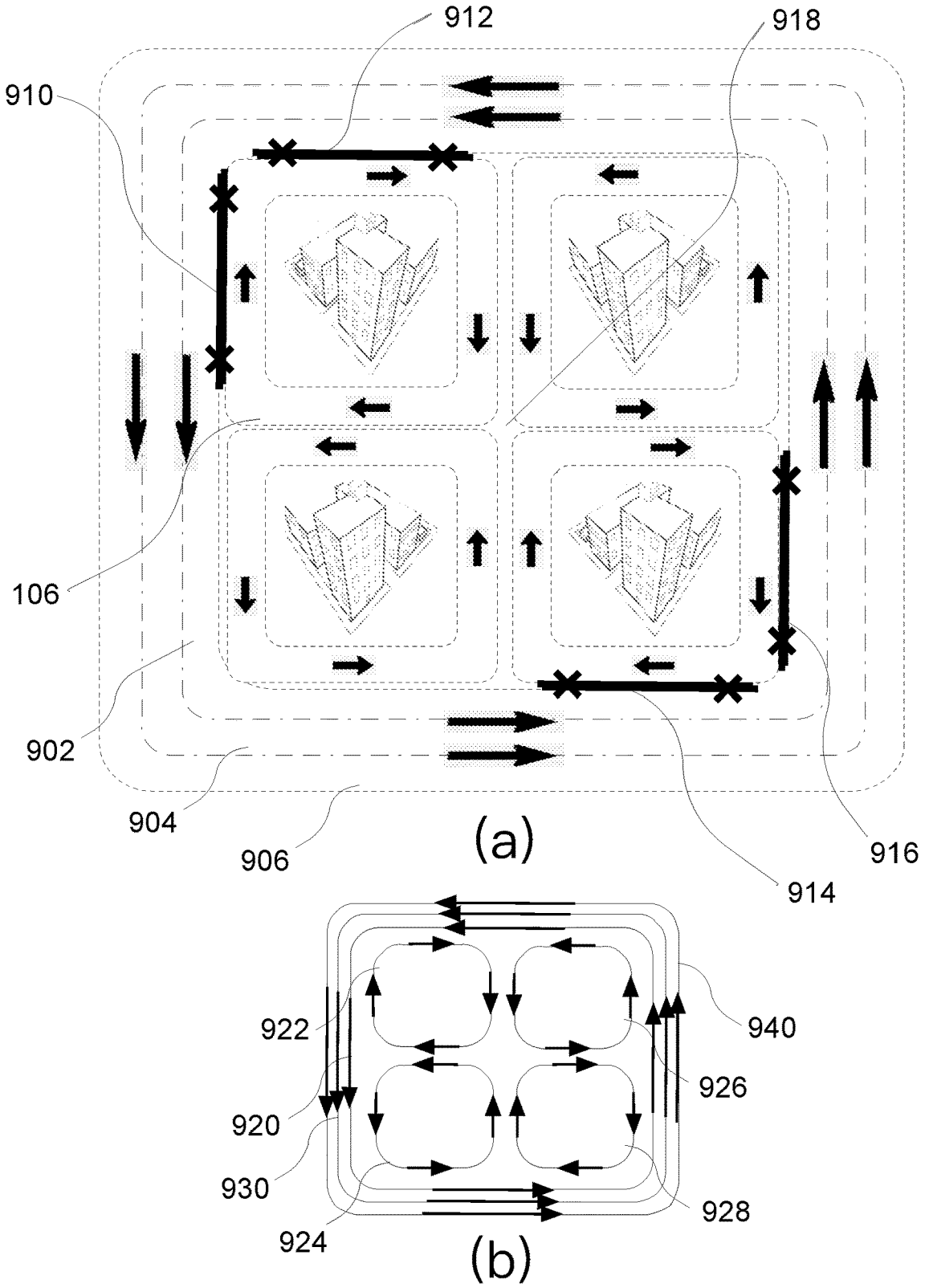
FIG. 9 illustrates an exemplary embodiment of nested mosaicking of five one-way loops and its corresponding vector representation of the present disclosure.

FIG. 9 illustrates an exemplary embodiment of nested or embedded mosaicking of five one-way loops and its corresponding vector representation of the present disclosure. Not only can a loop mosaicking mosaic another loop or loop mosaicking, but a loop can also embed or nest a loop or loop mosaicking. However, the rule of such embedding or nesting is that the resulted mosaicking must be connected. Completely disconnected embedding is not allowed.

Sub-Figure (a) illustrates two such embedded mosaicking examples. First a counter-clockwise one-way loop (902) is nested or embedded inside a counter-clockwise one-way loop (904). The loop (904) is nested or embedded inside another counter-clockwise one-way loop (906). Since all the loops (902, 904, 906) are counter-clockwise, their mosaicking is connected. All the traffic can freely switch lanes within the three-lane mosaicked loop, so this mosaicking is complete. Second, a standard four-loop basic mosaicking (918) as illustrated in FIG. 4 is embedded inside the above resulting nested loop (902, 904, 906). The top left basic loop of the standard four-loop mosaicking (918) is a clockwise basic loop. The top right basic loop is a counter-clockwise basic loop. The bottom left basic loop is a counter-clockwise basic loop. The bottom right basic loop is a clockwise basic loop. The overall mosaicking in Sub-Figure (a) is a connected mosaicking. Because though the lines (910, 912, 914, 916) are separating lines, all the other tangent lines between the outer loops (902, 904, 906) and the inner standard four-loop mosaicking (918) are connected. The standard four-loop mosaicking (918) is also connected. Therefore, the full mosaicking is connected and complete.

Sub-Figure (b) of FIG. 9 illustrates the vector representation of Sub-Figure (a). A counter-clockwise closed vector (920) is embedded inside a counter-clockwise closed vector (930). The vector (930) is embedded inside a counter-clockwise closed vector (940). The standard four-loop mosaicking is embedded inside the vector (920). The inside top left vector is a clockwise loop (922). The inside top right vector is a counter-clockwise loop (926). The inside bottom left vector is a counter-clockwise loop (924). The inside bottom right vector is a clockwise loop (928). This example represents a group of mosaicking with various nested/embedded mosaicking.

Figure 10:
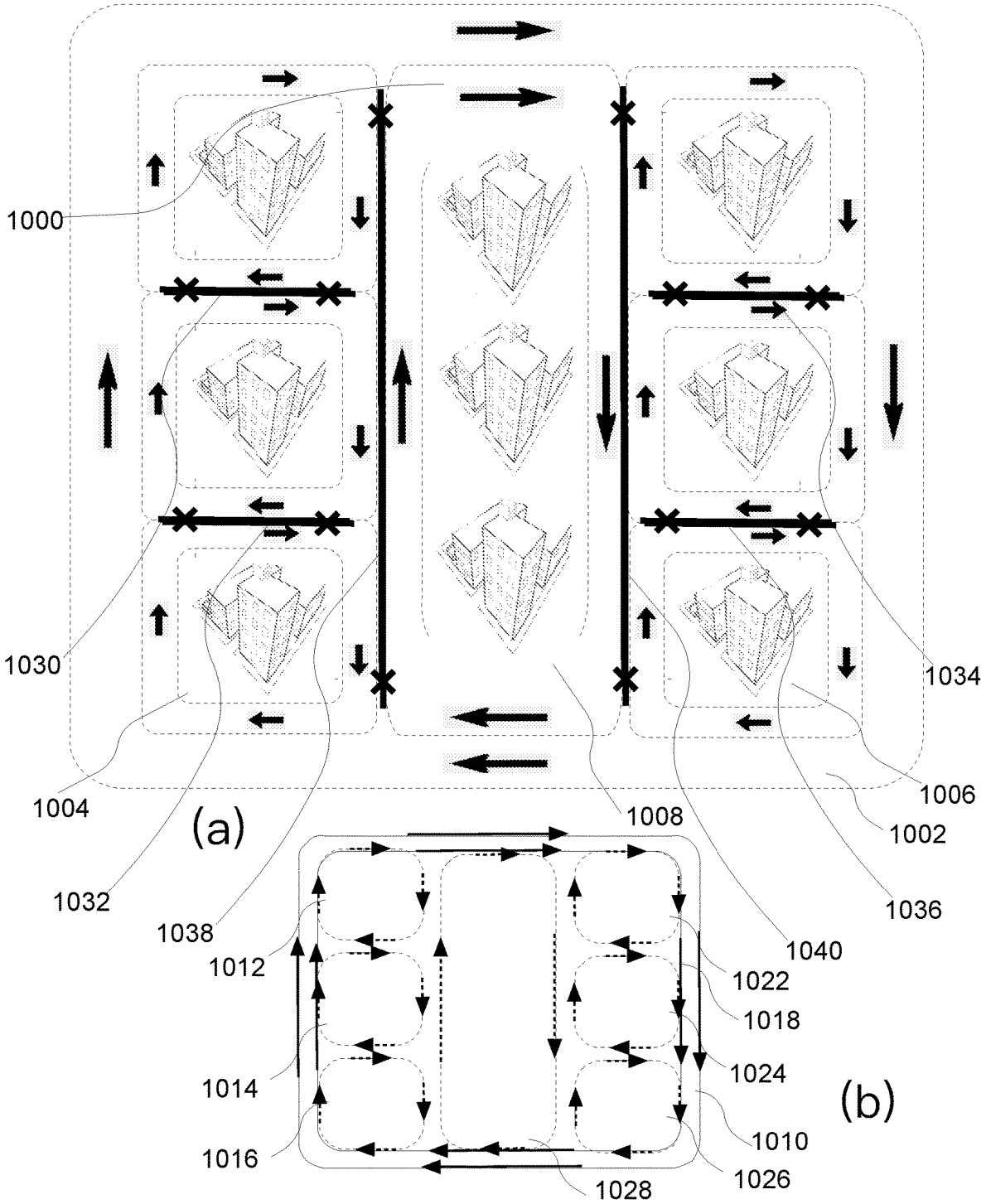
FIG. 10 illustrates an exemplary embodiment of hybrid mosaicking of eight one-way loops and its corresponding vector representation of the present disclosure.

FIG. 10 illustrates an exemplary embodiment of hybrid mosaicking of eight one-way loops and its corresponding vector representation of the present disclosure. Sub-Figure (a) is hybrid mosaicking. A total of seven basic one-way loops are embedded inside an outer clockwise single lane loop (1002). The outer loop (1002) provides fast transportation for the whole community. It is very much like the current beltline, beltway, ring road, or orbital of a big city. From the internal left side, three basic loops are mosaicked in a disjoint way. That is, all three basic loops are merged into a larger clockwise loop (1004). The inner disjoint lines (1030, 1032) and close-by lanes become local access. A similar thing happens on the right side; three basic loops are also mosaicked in a disjoint way. So, all three basic loops are merged into a larger clockwise loop (1006). The inner disjoint lines (1034, 1036) and close-by lanes become local access. Between these two merged loops (1004) and (1006), there is big clockwise basic loop (1008) in the middle. The three big loops (1004), (1006), and (1008) are also mosaicked in a disjoint way so that all three big loops are merged into an even bigger loop (1000). The tangent lines (1038) and (1040) are separating lines and traffic cannot cross. The inner vertical tangent lanes around the separating lines (1038) and (1040) all become local streets. Therefore, in this exemplary hybrid mosaicking, only the outer two lanes/loops (1000) and (1002) are connected. All other lanes become local access and streets.

Demerging a disconnected or connected mosaicking is a strategic and flexible choice left to a city designer in the present disclosure. The connectivity of mosaicking can also be modified after the roads have been built if the basic lanes have created and maintained.

Sub-Figure (b) illustrates the vector representation of the hybrid mosaicking example in Sub-Figure (a). The outer closed clockwise vector (1010) embeds an internal hybrid mosaicking. The internal hybrid mosaicking is resulted from the disconnected mosaicking of the basic loops (1012, 1014, 1016, 1022, 1024, 1026, 1028). This hybrid mosaicking forms a resulting loop (1018). All other disjoint sides (dashed vectors) become local access and are not part of the loop anymore. The resulting loop (1018) and the previous outer loop (1010) form a connected mosaicking. The mosaicking is still complete everywhere in that any lane is reachable.

Figure 11:
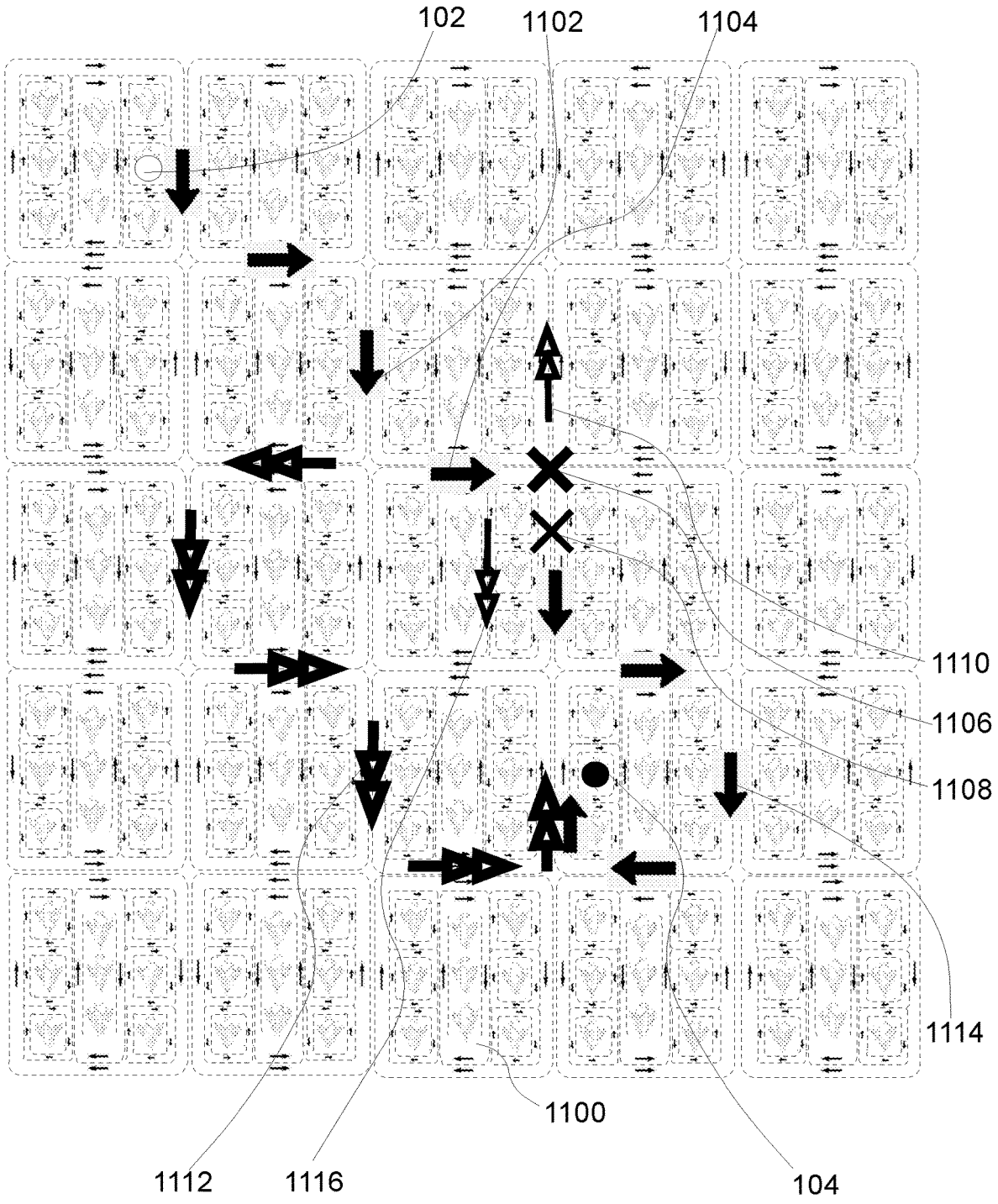
FIG. 11 illustrates an exemplary embodiment of general traffic control of the one-way loops mosaicking of the present disclosure.

FIG. 11 illustrates an exemplary embodiment of general traffic control of the one-way loop mosaicking of the present disclosure. Without loss of generality, assuming a city's transportation system is built by joint mosaicking millions of hybrid mosaicking blocks (1100) described in FIG. 10, because each block (1100) is complete and the mosaicking is connected, the whole city is also complete and connected. Traffic starts from a starting location (102) and wants to travel to a destination location (104). In the ideal case, the optimal path follows the solid black arrows from (102), (1102), (1104), (1114) to (104). This path has the shortest distance from (102) to (104) within the exemplary transportation system design of the present disclosure provided local access routes are not in the consideration. However, in reality, the optimal path may not always be possible and successful. For example, as we described before, if at any switching line, a vehicle fails to complete the lane switch, it may have to take an additional lap of the current loop to try the failed switch a second time. Or in a worse case, it has to try as many times as it might need until success. Another situation is a fatal failure. A fatal failure refers to a stop or close to a stop (congestion) of the traffic in that route. It is normally caused by, but is not limited to, rush-hour traffic, road closure or construction, an accident, vehicle breakdown, an emergent event, etc. If a fatal failure happens at the location (1106) and/or (1108), this failure will prevent traffic from reaching the destination location (104) through the optimal path. So, the traffic can immediately be rerouted and follow a new detoured path indicated by big double black arrows (1112). There are many other possible detours that can be chosen. Since every road is a one-way street, once a fatal failure happens, there might be some existing vehicles stuck in a dead-end road (1104) before the fatal failure location (1106) or (1108). For example, if the fatal failure location is (1108) not (1106), then the stuck vehicles in (1104) can easily evacuate the street and go through the path indicated by small double black arrows at (1110). If the fatal failure location is (1106) and/or (1108), then the stuck vehicles in (1104) can evacuate the street and go through the local access indicated by small double black arrows at (1116). The local access can reduce the transportation efficiency, however, the following traffic will not enter the dead-end road (1104) anymore upon knowing about the fatal failure at the location (1106), so the local access detour will only affect a small number of vehicles one time. After the failure is fixed or removed, the traffic will recover to the original optimal situation. This can be even more efficient if the affected vehicles are self-driving vehicles and the transportation system is smart. All the road conditions are reported and updated to all traffic in real-time. The overall traffic control can either be centralized at a city traffic center or distributed among all vehicles.

FIG. 11 illustrates a few of many examples of how a few fatal failures of traffic will not fail the new transportation system design of the present disclosure. Because the loop mosaicking is fully complete and connected, it will remain complete and connected at the basic one-way loop level with any number of road failures.

The same example can also illustrate how the new transportation system can be built/implemented in phases and still be compatible with existing streets. The old streets and city areas can be treated as a partially failed block. Any traffic in the new transportation system can choose to detour around it or enter the old streets and travel in the old ways.

The traffic fatal failures, old city streets and blocks, roadside accidents, and traffic volume may cause traffic congestion from time to time. The new transportation system design based on the one-way loop mosaicking of the present disclosure is a fully connected and complete system. If a pair of location coordinates are given, the travel path from one location to the other location has an optimal arrangement, which can be the best in travel distance, travel time, travel safety, or by other criteria. If the congestion on each route is also considered in the path planning, then a congestion level or score can be used to weight each route, so an optimal path with the least overall congestion can be calculated. This is part of the discussion on traffic control and/or vehicle self-driving algorithms, which is not a major part of the present disclosure.

In one aspect of the new transportation of the present disclosure, all traffic is designed to transport in a non-stopping and least conflicting way. The only conflict at loop level is lane-changing. Because vehicles keep almost the same speed during lane changes, all traffic in the new transportation system constantly travels at fast speeds. We all know that frequent starting and stopping of vehicles is the major contributor of city pollution. Since the new system almost eliminates the reason for traffic to slow down or stop, city pollution can be reduced and gas efficiency can be improved. Further, vehicles using less gas can save money on transportation. The new system also encourages more ridesharing and saves on overall transportation costs for both individuals and the city. If travelling vehicles are mostly public transportation, like taxis, ubering cars, or buses, people might choose not to own and drive their own vehicles anymore. This would also require much less city and/or private space for vehicle parking facilities.

Road throughput or capacity can be calculated by finding a theoretic number of vehicles that can travel past a given location for a unit of time. This is a function of vehicle travel speed and spacing between vehicles. Assuming vehicle spacing is fixed, then the capacity is only proportional to vehicle speed so the new design of the present disclosure will improve transportation capacity. The spacing between vehicles can be reduced reliably by autonomous vehicles, so autonomous driving under the new transportation design can further improve road capacity and efficiency. For an individual trip, the new design might increase travel distance by a factor of $\sqrt{2}-1\approx0.414$; however, because the new design eliminates the stopping and slowing down, the speed improvement outweighs it. For example, average city driving speed now is 50 km/h, while the speed can easily be 80 km/h with the new system of the present disclosure; so the improvement is 0.6. The overall travel time or efficiency improvement is the product of the change ratios of the travel distance and speed; therefore, the final travel time is reduced by 45%, or in other words, the travel efficiency can be improved by 45%.

Because the new transportation design of the present disclosure solves the problems using only two-dimensional mosaicking, there is no need to build or design three-dimensional separation solutions for major city routes, which are much more expensive. However, this does not limit the 3D separation and/or other traditional 2D separation methods for local access and/or pedestrian traffic management in the present disclosure. For example, there are at least three ways to separate pedestrian from automotive traffic. First, pedestrian uses under-ground sideways, whereas automotive traffic takes ground level; second, pedestrian uses bridges, whereas automotive traffic takes ground level; third, pedestrian takes ground level, whereas automotive traffic uses bridges.

The invention claimed is:

1. A method of creating or improving a transportation system for motorized vehicles, comprising:

providing a first one-way loop route that allows traffic in a first direction;

wherein the traffic is not allowed to stop anywhere in the loop and obeys a first speed limit;

providing a second one-way loop route that allows traffic in a second direction;

wherein the traffic is not allowed to stop anywhere in the loop and obeys a second speed limit;

wherein the second direction is the opposite of the first direction;

wherein the first and second speed limits are common city and highway limits;

mosaicking the first loop with the second loop along a first shared boundary between the first and second loops;

wherein the traffic directions parallel to the first boundary are the same on both sides of the first boundary;

wherein the traffic from one loop can enter the other loop only through lane-changing from one side of the first boundary to the other;

wherein the boundary is a shared edge or one or more lanes;

wherein no crossing conflict is possible.

2. The method of claim 1, wherein the shape of the first loop route or the second loop route is a circle, rectangle, triangle, or polygon.

3. The method of claim 1, whereas the second direction is the same as the first direction;

wherein the traffic directions parallel to the first boundary are different on both sides of the first boundary;

wherein the traffic from one loop cannot enter the other loop at all.

4. The method of claim 3, wherein the traffic from one loop can enter the other loop through lane-merging but not lane-changing from one side of the first boundary to the other.

5. The method of claim 1, further comprising:

providing a third one-way loop route that allows traffic in the second direction;

wherein the traffic is not allowed to stop anywhere in the loop and obeys a third speed limit;

wherein the third speed limit is a common city and highway limit;

mosaicking the third loop with the first loop along a second shared boundary between the first and third loops;

wherein the traffic directions are same on both sides of the second boundary;

wherein the traffic from one of the first and third loop can enter the other loop only through lane-changing from one side of the second boundary to the other.

6. The method of claim 3, further comprising:

providing a third one-way loop route that allows traffic in the opposite of the first direction;

wherein the traffic is not allowed to stop anywhere in the loop and obeys a third speed limit;

wherein the third speed limit is a common city and highway limit;

mosaicking the third loop with the first loop along a second shared boundary between the first and third loops;

wherein the traffic directions are same on both sides of the second boundary;

mosaicking the third loop with the second loop along a third shared boundary between the second and third loops;

wherein the traffic directions are same on both sides of the third boundary;

wherein the traffic from one loop can enter the other loop only through lane-changing from one side of the second boundary to the other side of the second boundary or from one side of the third boundary to the other side of the third boundary.

7. The method of claim 4, further comprising:

providing a third one-way loop route that allows traffic in the opposite of the first direction;

wherein the traffic is not allowed to stop anywhere in the loop and obeys a third speed limit;

wherein the third speed limit is a common city and highway limit;

mosaicking the third loop with the first loop along a second shared boundary between the first and third loops;

wherein the traffic directions are same on both sides of the second boundary;

wherein, the traffic from the first loop can enter the third loop or vice versa only through lane-changing from one side of the second boundary to the other.

8. The method of claim 3, wherein the second loop is mosaicked inside the first loop along a first shared boundary between the first and second loops;

wherein the travel directions are same on both sides of the first boundary;

wherein, the traffic from one loop can enter the other loop only through lane-changing from one side of the first shared boundary to the other.

9. The method of claim 8, wherein the second loop is a result of mosaicking.

10. The method of claim 5, wherein the third loop is a result of mosaicking.

11. The method of claim 6, wherein the third loop is a result of mosaicking.

12. The method of claim 7, wherein the third loop is a result of mosaicking.

13. The method of claim 4, wherein the lanes parallel and adjacent to the first boundary become local streets; wherein the traffic can access the local streets through traditional traffic control means for parking, stopping, or standing.

14. The method of claim 1, wherein the traffic includes an autonomous vehicle and/or traffic control center; wherein the vehicle and control center are sharing data.

15. A transportation system for motorized vehicles, comprising:

a first one-way loop route that allows traffic in a first direction without stopping;

a second one-way loop route that allows traffic in a second direction without stopping;

wherein the first loop is mosaicked with the second loop along a shared boundary between the first and second loops;

a traffic control center processor that controls the traffic from one loop entering the other loop only under a first or second condition;

wherein the first condition is lane-changing from one side of the boundary to the other if the traffic directions are same on both sides of the boundary;

wherein the second condition is lane-merging from one side of the boundary to the other if the traffic directions are different on both sides of the boundary, wherein the boundary is a shared edge or one or more lanes;

wherein no crossing conflict is possible.

16. The transportation system of claim 15, wherein the shape of the first loop route or the second loop route is a circle, rectangle, triangle, or polygon.

17. The transportation system of claim 15, wherein the second loop is mosaicked inside the first loop along the shared boundary between the first and second loops.

18. The transportation system of claim 15, furthering comprising: a third one-way loop route that allows traffic in the second direction without stopping; wherein the third loop is mosaicked with the first loop along a shared boundary between the first and third loops; wherein the traffic from one of the first and third loops can enter the other loop only through lane-changing from one side of the shared boundary between the first and third loops to the other.

19. The transportation system of claim 17, wherein the second loop is a result of mosaicking.

20. The transportation system of claim 18, wherein the third loop is a result of mosaicking.

* * * * *